US011641081B2

(12) United States Patent
Chen et al.

(10) Patent No.: US 11,641,081 B2
(45) **Date of Patent: *May 2, 2023**

(54) CONNECTOR WITH IMPROVED SHIELDING EFFECT

(71) Applicant: DONGGUAN LUXSHARE TECHNOLOGIES CO., LTD, Dongguan (CN)

(72) Inventors: Chinyu Chen, Dongguan (CN); Szuhsien Wu, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/702,377

(22) Filed: Mar. 23, 2022

(65) Prior Publication Data

US 2022/0216652 A1 Jul. 7, 2022

Related U.S. Application Data

(63) Continuation of application No. 17/090,241, filed on Nov. 5, 2020, now Pat. No. 11,316,307.

(30) Foreign Application Priority Data

Nov. 14, 2019 (CN) ..... 201911111029.6

(51) Int. Cl.
*H01R 13/648* (2006.01)
*H01R 13/6584* (2011.01)
(Continued)

(52) U.S. Cl.
CPC ..... *H01R 13/6584* (2013.01); *H01R 12/58* (2013.01); *H01R 13/6461* (2013.01); *H01R 13/6587* (2013.01)

(58) Field of Classification Search
CPC ..... H01R 13/6587; H01R 13/6584; H01R 13/6461; H01R 12/58; H01R 12/585
(Continued)

(56) References Cited

U.S. PATENT DOCUMENTS 8,864,522 B2 10/2014 Lan et al.
11,316,307 B2 * 4/2022 Chen ..... H01R 13/6599
(Continued)

FOREIGN PATENT DOCUMENTS

CN 2699515 Y 5/2005
CN 101521337 A 9/2009
(Continued)

*Primary Examiner* — Khiem M Nguyen
(74) *Attorney, Agent, or Firm* — Birch, Stewart, Kolasch & Birch, LLP

(57) ABSTRACT

The present disclosure a connector including a housing, a terminal module, a metal plate and a shielding member. The housing is provided with a slot. The terminal module includes a number of signal terminals and an insulating block. Each signal terminal is provided with a contact portion extending into the slot. The metal plate and the at least one terminal module are arranged side by side along a thickness direction of the connector. The shielding member extends along the thickness direction to contact the insulating block and to be electrically connected to the ground plate.

20 Claims, 9 Drawing Sheets

(51) Int. Cl.
*H01R 12/58* (2011.01)
*H01R 13/6461* (2011.01)
*H01R 13/6587* (2011.01)

(58) Field of Classification Search
USPC ..... 439/79, 607.01
See application file for complete search history.

(56) References Cited

U.S. PATENT DOCUMENTS

| | | | |
|---|---|---|---|
| 2015/0303618 | A1 | 10/2015 | Lee et al. |
| 2021/0151938 | A1 | 5/2021 | Chen et al. |

FOREIGN PATENT DOCUMENTS

| | | | |
|---|---|---|---|
| CN | 203339423 | U | 12/2013 |
| CN | 204615079 | U | 9/2015 |
| CN | 204720596 | U | 10/2015 |
| CN | 205141283 | U | 4/2016 |
| CN | 105742854 | A | 7/2016 |
| CN | 109546384 | A | 3/2019 |
| CN | 110768065 | A | 2/2020 |
| CN | 210866668 | U | 6/2020 |
| WO | WO 2007/005597 | A3 | 1/2007 |

* cited by examiner

CONNECTOR WITH IMPROVED SHIELDING EFFECT

CROSS-REFERENCE TO RELATED APPLICATIONS

This patent application is a continuation of U.S. patent application Ser. No. 17/090,241, filed on Nov. 5, 2020, which is in condition for allowance and claims priority of a Chinese Patent Application No. 201911111029.6, filed on Nov. 14, 2019 and titled "CONNECTOR", the disclosures of which are incorporated herein by reference in their entireties.

TECHNICAL FIELD

The present disclosure relates to a connector, in particular to a high-speed connector.

BACKGROUND

High-speed connectors need to ensure that the data transmission between the signal terminals is free from external interference during signal transmission so as to improve the quality of data transmission. In order to solve the above-mentioned technical problem, some connectors are provided with ground plates near the signal terminals to prevent signal cross-talk. However, these ground plates are spaced apart and arranged separately, which does not facilitate to achieve a better shielding effect.

SUMMARY

An object of the present disclosure is to provide a connector which can achieve a better shielding effect.

In order to achieve the above object, the present disclosure adopts the following technical solution: a connector including a housing, at least one terminal module, at least one metal plate and a shielding member. The housing includes a receiving cavity, a mating surface, and a slot extending through the mating surface and communicating with the receiving cavity. The at least one terminal module is art least partially accommodated in the receiving cavity. The at least one terminal module includes a plurality of signal terminals and an insulating block covering the signal terminals. Each signal terminal is provided with a contact portion extending into the slot. The at least one metal plate and the at least one terminal module are arranged side by side along a thickness direction of the connector. The shielding member extends along the thickness direction to contact the insulating block and is electrically connected to the at least one metal plate.

Compared with the prior art, the present disclosure increases the shielding area by providing a shielding member, and can achieve a better shielding effect.

DETAILED DESCRIPTION

Figure 1:
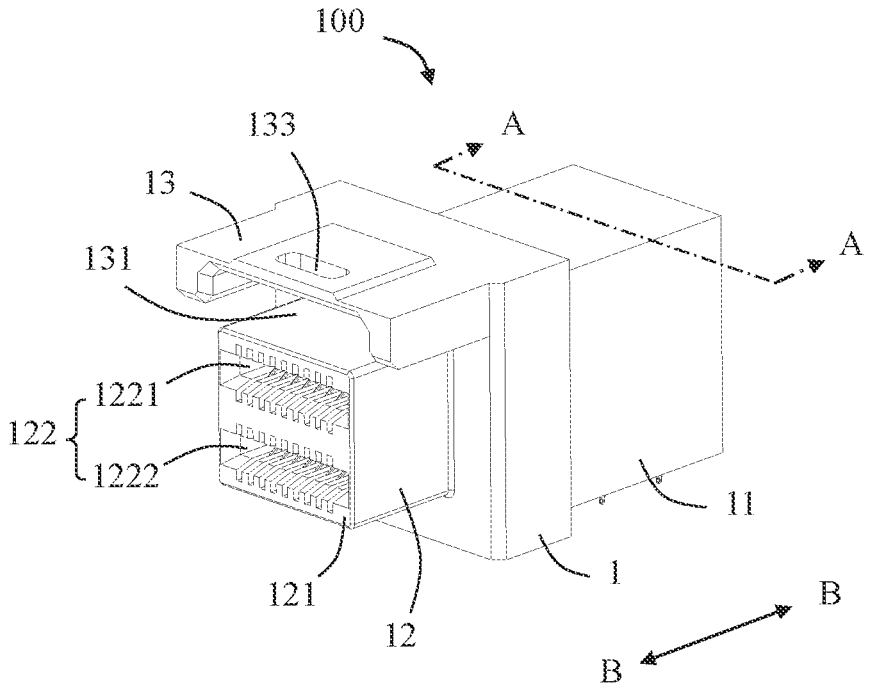
FIG. 1 is a perspective view of a connector in accordance with an embodiment of the present disclosure.
Figure 2:
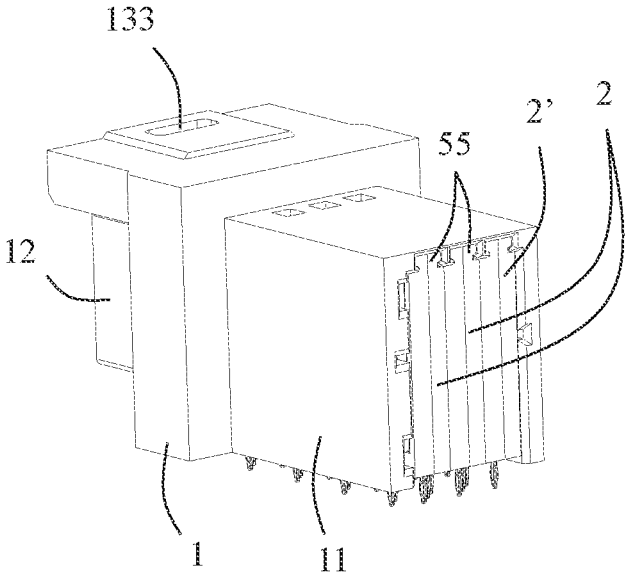
FIG. 2 is a perspective schematic view of FIG. 1 from another angle.
Figure 3:
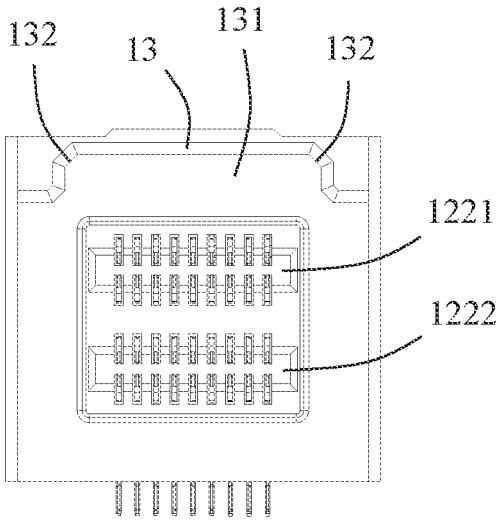
FIG. 3 is a front view of FIG. 1.
Figure 4:
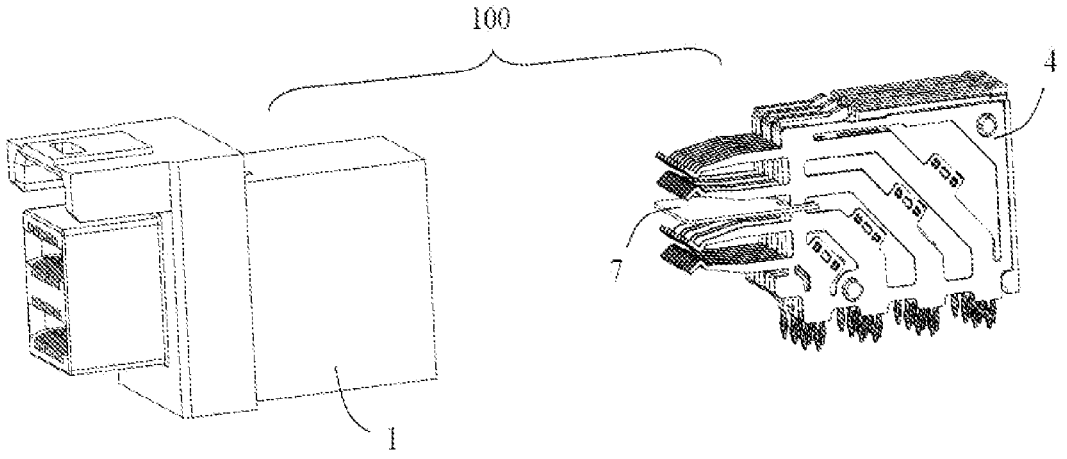
FIG. 4 is a partially exploded perspective view of the connector of the present disclosure.

Referring to FIGS. 1 to 15, the present disclosure discloses a connector 100 for mating with a mating connector (not shown) along a mating direction B-B. The connector 100 includes a housing 1, a plurality of terminal modules 2 installed in the housing 1, and a plurality of ground plates 4 arranged side by side with the terminal modules 2. In an embodiment of the present disclosure, each terminal module 2 is assembled with one ground plate 4, and the ground plate 4 is installed on a side of the corresponding terminal module 2 along a thickness direction of the connector 100. Of course, in other embodiments, each terminal module 2 can also be assembled with two ground plates 4 along the thickness direction of the connector 100. For example, the two ground plates 4 are installed on opposite sides of the corresponding terminal module 2, respectively.

Figure 5:
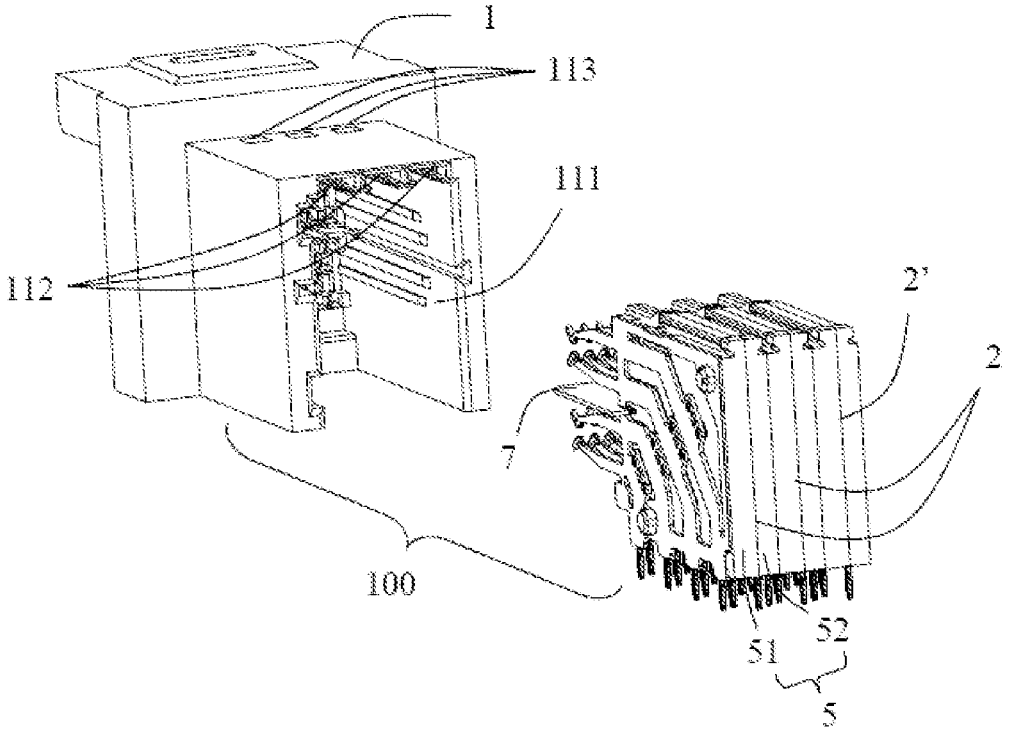
FIG. 5 is a partially exploded perspective view of FIG. 4 from another angle.
Figure 6:
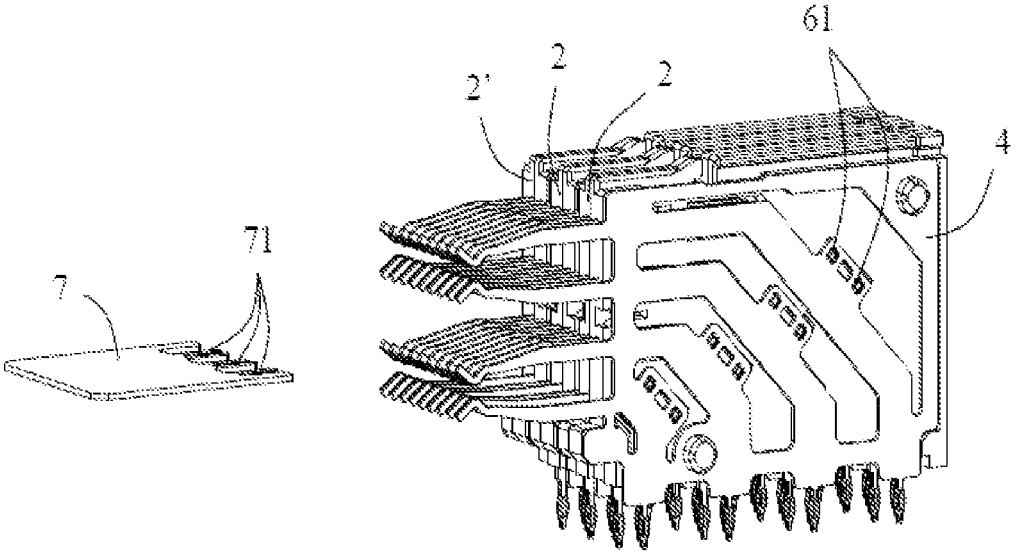
FIG. 6 is a perspective schematic view of several terminal modules and shielding plates in FIG. 4 after being separated.

The housing 1 includes a base 11, a mating portion 12 protruding forwardly from the base 11, and a buckle portion 13 located above the mating portion 12. Referring to FIG. 5, the base 11 includes a receiving cavity 111 for receiving the terminal modules 2, a plurality of mounting slots 112 located on the top of the base 11 and communicating with the receiving cavity 111, and a plurality of buckle holes 113 located in front of the mounting slots 112. In the illustrated embodiment of the present disclosure, each mounting slot 112 is of a T-shaped configuration which is used to guide and position the corresponding terminal module 2. The buckle holes 113 are used to lock the terminal modules 2 in order to prevent the terminal modules 2 from escaping from the housing 1. The mating portion 12 has a mating surface 121 and a slot 122 extending through the mating surface 121 and communicating with the receiving cavity 111. In the illustrated embodiment of the present disclosure, the slot 122 includes a first slot 1221 and a second slot 1222 located below the first slot 1221. The first slot 1221 and the second slot 1222 are used for receiving tongue plates (not shown) of the mating connector. A guide groove 131 is provided between the buckle portion 13 and the mating portion 12. The buckle portion 13 is provided with a pair of inclined guide surfaces 132 located on both sides of the guide groove 131 and a locking hole 133 in communication with the guide groove 131. The guide groove 131 is used to receive a buckle plate of the mating connector. The locking hole 133 is used to cooperate with a protrusion on the buckle plate, so that the connector 100 and the mating connector can be locked together.

In the illustrated embodiment of the present disclosure, the plurality of terminal modules 2 include three groups of the terminal modules 2 which are arranged side by side along the thickness direction of the connector 100 and have the same structure. Each terminal module 2 includes a plurality of signal terminals 3. Each signal terminal 3 is provided with a contact portion 30 extending into the slot 122. In the illustrated embodiment of the present disclosure, each terminal module 2 includes an insulating block 5 in which the signal terminals 3 are insert-molded. That is, the insulating block 5 is molded to cover the signal terminals 3. The ground plate 4 is installed on a side of the insulating block 5. The insulating block 5 is provided with an elastic holding arm 54 at a top of the insulating block 5 and a mounting bar 55 in rear of the elastic holding arm 54. The elastic holding arm 54 is provided with a locking protrusion 540 for mating with the corresponding buckle hole 113. The mounting bar 55 is T-shaped so as to be able to be locked in the corresponding mounting slot 112.

Specifically, the insulating block 5 of each terminal module 2 includes a first insulating block 51 and a second insulating block 52. The signal terminals 3 of each terminal module 2 include a plurality of first signal terminals 31 insert-molded in the first insulating block 51 and a plurality of second signal terminals 31 insert-molded in the second insulating block 52. The first signal terminals 31 and the second signal terminals 32 form a plurality of differential pairs in order to increase the speed of data transmission.

Figure 9:
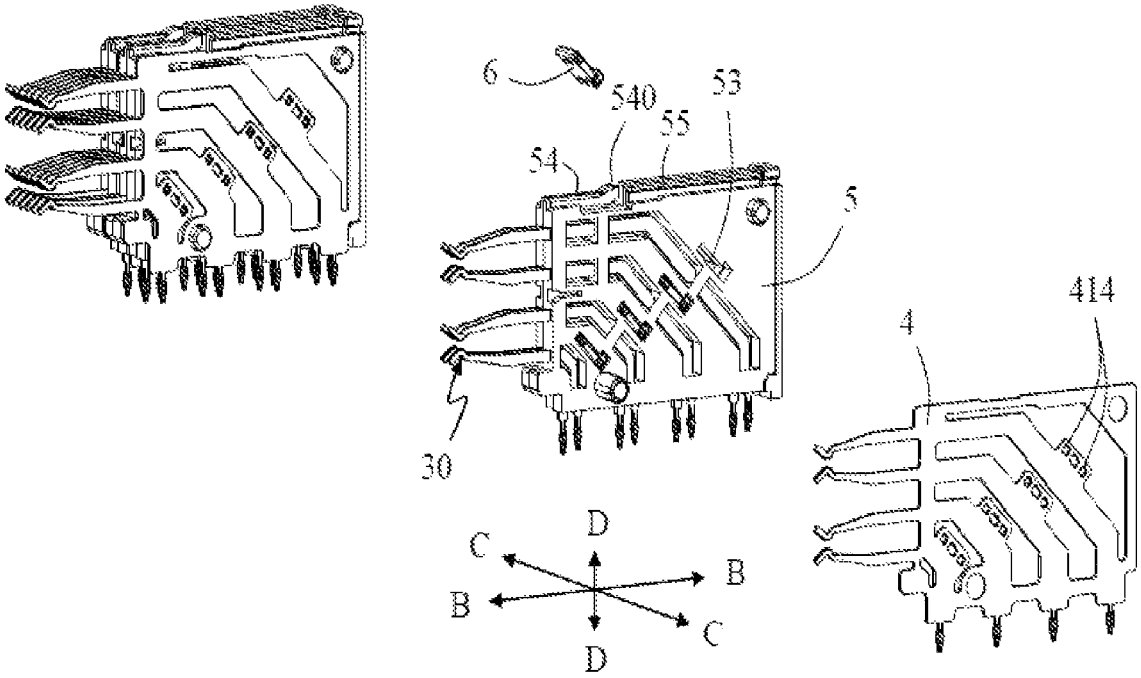
FIG. 9 is a further perspective exploded view of FIG. 8 with a shielding member being separated.
Figure 10:
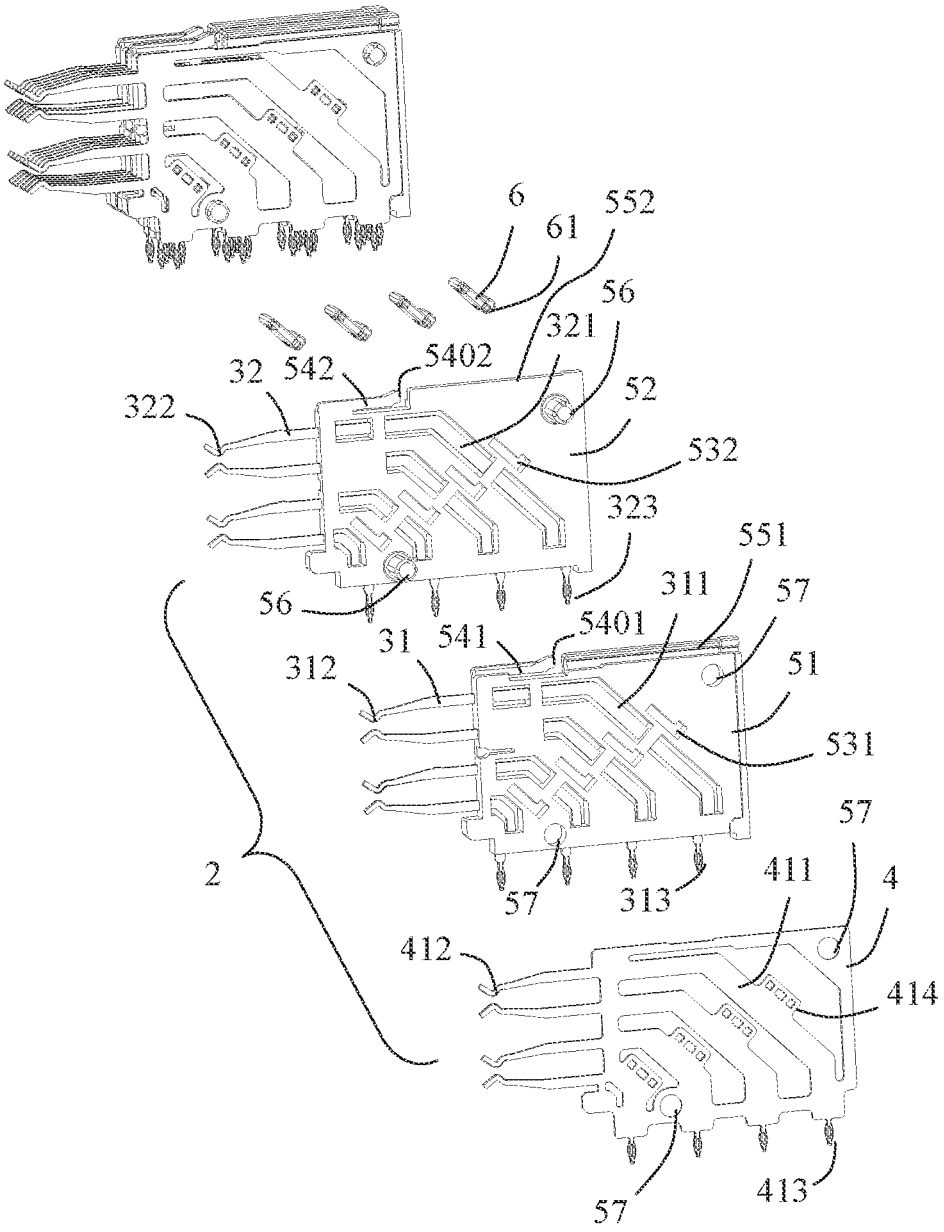
FIG. 10 is a further perspective exploded view of FIG. 9 in which one terminal module and several shielding members corresponding to the terminal module are separated.

Referring to FIGS. 9 and 10, in the illustrated embodiment of the present disclosure, the elastic holding arm 54 includes a first elastic holding arm 541 formed on the first insulating block 51 and a second elastic holding arm 542 formed on the second insulating block 52. Correspondingly, the locking protrusion 540 includes a first locking protrusion 5401 located on the first elastic holding arm 541 and a second locking protrusion 5402 located on the second elastic holding arm 542. The first locking protrusion 5401 and the second locking protrusion 5402 of the same terminal module 2 are jointly held in the same buckle hole 113. This arrangement can prevent the first insulating block 51 and the second insulating block 52 from being separated from each other.

Similarly, the mounting bar 55 includes a first mounting bar 551 on the first insulating block 51 and a second mounting bar 552 on the second insulating block 52. The first mounting bar 551 and the second mounting bar 552 of the same terminal module 2 are jointly locked in the same mounting slot 112. This arrangement can prevent the first insulating block 51 and the second insulating block 52 from being separated from each other.

In addition, the second insulating block 52 is also provided with a plurality of mounting posts 56. Both the first insulating block 51 and the ground plate 4 are provided with a plurality of through holes 57 to receive the mounting posts 56. With this arrangement, the components of each terminal module 2 can be closely combined with each other to avoid loosening.

Each terminal module 2 includes four first signal terminals 31 fixed in the first insulating block 51 and four second signal terminals 32 fixed in the second insulating block 52. In the illustrated embodiment of the present disclosure, the first signal terminals 31 and the second signal terminals 32 are insert-molded in the first insulating block 51 and the second insulating block 52, respectively. The four first signal terminals 31 and the four second signal terminals 32 are divided into two groups and extend into the first slot 1221 and the second slot respectively.

Referring to FIG. 10, the first signal terminal 31 of each terminal module 2 includes a first intermediate portion 311, a first contact portion 312 extending from one end of the first intermediate portion 311, and a first tail portion 313 extending from the other end of the first intermediate portion 311. The first intermediate portion 311 is located inside the first insulating block 51. The first contact portion 312 protrudes from a front side of the first insulating block 51 along a direction parallel to the mating direction B-B of the connector 100. The first tail portion 313 protrudes from a bottom side of the first insulating block 51 along a mounting direction D-D perpendicular to the mating direction B-B of the connector 100. The second signal terminal 32 of each terminal module 2 includes a second intermediate portion 321, a second contact portion 322 extending from one end of the second intermediate portion 321, and a second tail portion 323 extending from the other end of the second intermediate portion 321. The second intermediate portion 321 is located inside the second insulating block 52. The second contact portion 322 protrudes from a front side of the second insulating block 52 along the direction parallel to the mating direction B-B of the connector 100. The second tail portion 323 protrudes from a bottom side of the second insulating block 52 along the mounting direction D-D perpendicular to the mating direction B-B of the connector 100. Each ground plate 4 is integrally stamped from a metal plate. The ground plate 4 includes a third intermediate portion 411, a third contact portion 412 extending from one end of the third intermediate portion 411, and a third tail portion 413 extending from the other end of the third intermediate portion 411. The third contact portion 412 extends into the slot 122 and extends along the direction parallel to the mating direction B-B of the connector 100. The third tail portion 413 extends along the mounting direction D-D perpendicular to the mating direction B-B of the connector 100. The contact portion 30 includes the first contact portion 312, the second contact portion 322 and the third contact portion 412. The first tail portion 313, the second tail portion 323 and the third tail portion 413 are used for being electrically connected to a circuit board (not shown).

Figure 12:
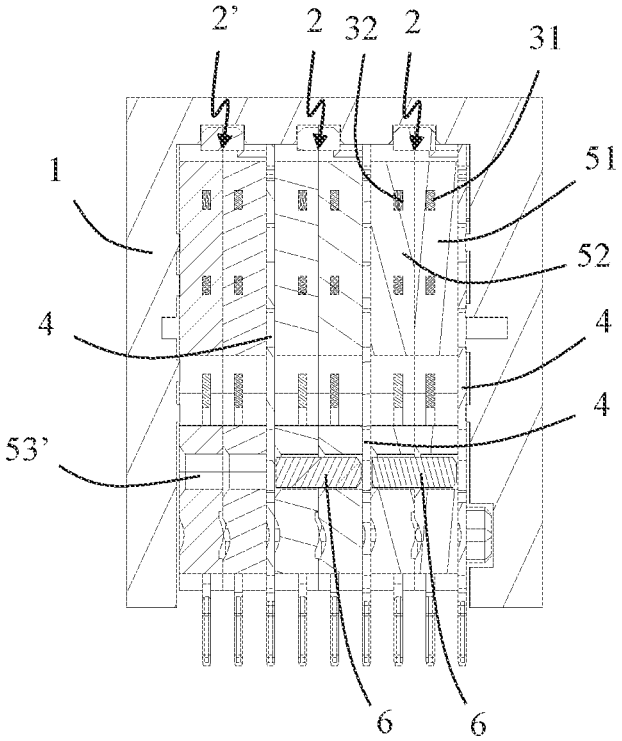
FIG. 12 is a schematic cross-sectional view taken along line A-A in FIG. 1.

The connector 100 is also provided with a plurality of shielding members 6 which connect the ground plates 4 in series. In the illustrated embodiment of the present disclosure, the shielding members 6 are divided into same three groups. Each group includes four shielding members 6. As shown in FIG. 12, a first group of the shielding members 6 is installed on the rightmost terminal module 2, a second group of the shielding members 6 is installed on the middle terminal module 2, and a third group of the shielding members 6 is installed on the leftmost terminal module 2. Each shielding member 6 extends along the thickness direction to contact a corresponding insulating block 5 of a corresponding one of the terminal modules 2 and to be electrically connected to a corresponding one of the ground plates 4. Each shielding member 6 extends through a corresponding insulating block 5 and a corresponding ground plate 4 along the thickness direction. In an embodiment, each shielding member 6 extends through a corresponding insulating block 5 so as to contact a corresponding ground plate 4 along the thickness direction. As shown in FIGS. 9 and 10, in the illustrated embodiment of the present disclosure, the insulating block 5 is provided with a plurality of perforation holes 53, the ground plates 4 are provided with a plurality of through holes 414, and the perforation holes 53 are in communication with the corresponding through holes 414. The shielding members 6 are inserted in the perforation holes 53 and the through holes 414 along the thickness direction to connect the terminal modules 2 and the ground plates 4 in series. At the same time, the shielding members 6 can be installed without increasing the size of the terminal modules 2 additionally. In the illustrated embodiment of the present disclosure, the embodiment in which the shielding members 6 are inserted into the perforation holes 53 and the through holes 414 may be that the shielding members 6 contact the ground plates 4 and do not contact the signal terminals 31 of the terminal modules 2. With this arrangement, the shielding members 6 are electrically connected to the ground plates 4 to achieve a better grounding effect. Moreover, the shielding members 6 are not electrically connected to the signal terminals 31 to prevent signal interference and solve crosstalk resonance. Another embodiment in Which the shielding members 6 are inserted into the perforation holes 53 and the through holes 414 may also be that the shielding members 6 are spaced from the ground plates 4 and do not contact the ground plates 4. Through electrical coupling, the shielding members 6 can still be electrically connected to the ground plates 4 to achieve a grounding effect. At the same time, the shielding members 6 do not contact the signal terminals 31 to prevent signal interference and solve crosstalk resonance. In addition, referring to FIG. 12, in the illustrated embodiment of the present disclosure, the connector 100 may also include a low-speed terminal module 2' (that is, the terminal module located on the leftmost side in FIG. 12). The low-speed terminal module 2' includes a plurality of low-speed signal terminals. The shielding members 6 can be optionally installed in the perforation holes 53' of the low-speed terminal module 2' depending on different considerations. In other words, the shielding members 6 may be inserted into the perforation holes 53' of the low-speed terminal module 2', or not inserted into the perforation holes 53' of the low-speed terminal module 2' (see FIG. 12).

Referring to FIG. 10, the perforation holes 53 include a first perforation hole 531 formed on the first insulating block 51 and a second perforation hole 532 formed on the second insulating block 52. The shielding members 6 are inserted into the first perforation hole 531 and the second perforation hole 532 to connect the first insulating block 51 and the second insulating block 52 of the terminal modules 2 in series.

In the illustrated embodiment of the present disclosure, a plurality of the shielding members 6, a plurality of the first perforation holes 531 and a plurality of the second perforation holes 532 are provided. first perforation holes 531 communicate with the corresponding second perforation holes 532. A plurality of the shielding members 6 are respectively inserted in the first perforation holes 531 and the second perforation holes 532 in communication with each other in order to connect the first insulating block 51 and the second insulating block 52 of the terminal modules 2 in series. In addition, as shown in FIG. 12, each adjacent two shielding members 6 along the thickness direction are in contact with each other. In other words, the shielding members along the thickness direction are connected in series. Therefore, a larger shielding area can be achieved to improve the shielding effect of the connector 100.

Referring to FIGS. 8 to 12, a plurality of ground plates 4 are provided. Two of the plurality of ground plates 4 are arranged on the outer sides of the first insulating block 51 and the second insulating block 52, respectively. The shielding member 6 is inserted into the first perforation hole 531, the second perforation hole 532 and the through hole 414 to connect the first insulating block 51, the second insulating block 52 and the two ground plates 4 in series. In the illustrated embodiment of the present disclosure, the shielding member 6 contacts inner wall surfaces of the through holes 414 of the two ground plates 4 provided on the outside of the first insulating block 51 and the second insulating block 52, so that the shielding member 6 is electrically connected to the two ground plates 4. The shielding member 6 extends along the thickness direction to contact the insulating block 5 and the two ground plates 4 on the opposite sides of the insulating block 5.

Figure 7:
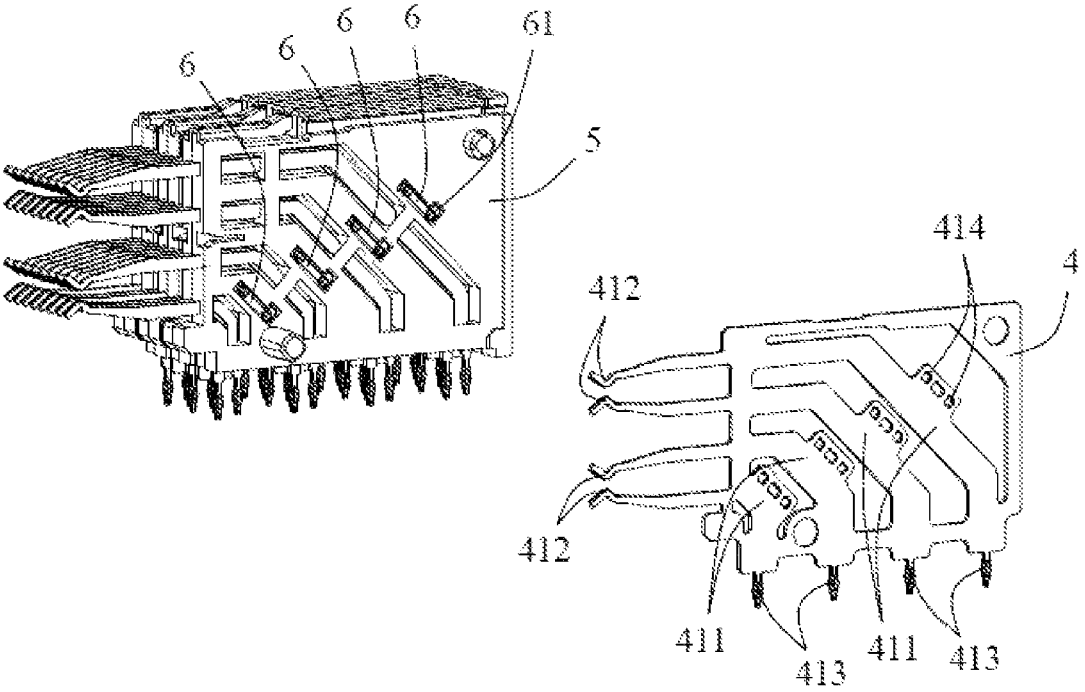
FIG. 7 is a perspective schematic view after separating a ground plate of one of the terminal modules in FIG. 6.
Figure 8:
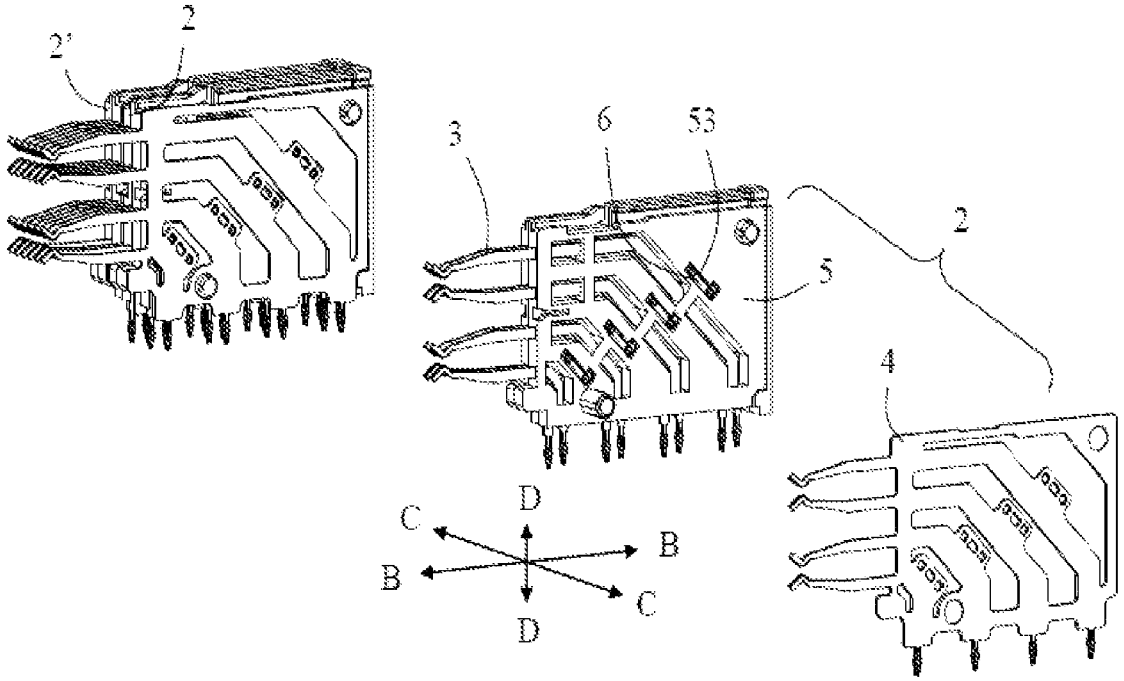
FIG. 8 is a further perspective exploded view of FIG. 7 with one terminal module being separated.

Referring to FIG. 7, in the illustrated embodiment of the present disclosure, the through hole 414 is formed on the third intermediate portion 411 of the ground plate 4.

In addition, by inserting the shielding member 6 into the insulating block 5, the shielding member 6 can also be better protected to prevent it from loosening due to external forces. In the illustrated embodiment of the present disclosure, the shielding member 6 is made of a conductive plastic, but it is not limited to the conductive plastic. In other embodiments, the shielding member 6 may also be made of or include other conductive materials, such as metals, alloys, and the like. The shielding member 6 can also be made of electromagnetic loss material or wave absorbing material or include electromagnetic loss material or wave absorbing material.

In addition, the shielding member 6 has a columnar shape, extends along an installation direction C-C, and extends through the perforation hole 53 and the through hole 414. In the illustrated embodiment of the present disclosure, the shielding member 6 has an L-shaped column shape.

A plurality of the shielding members 6 are provided. The installation direction C-C of the shielding members 6 is perpendicular to the mating direction B-B of the connector. In an embodiment, in the installation direction C-C, the corresponding shielding members 6 are aligned. It is understandable to those of ordinary skill in the art that the installation direction C-C is the thickness direction of the connector 100. Each adjacent two shielding members 6 along the thickness direction are electrically connected with each other.

Figure 11:
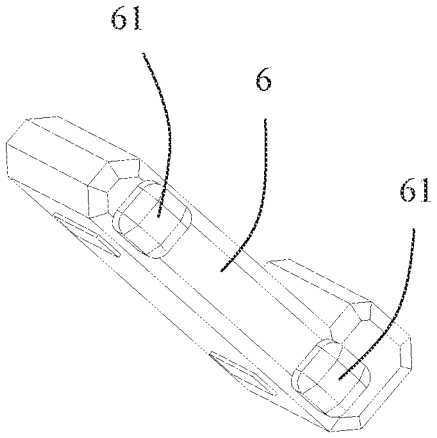
FIG. 11 is a perspective schematic view of the shielding member in FIG. 10.
Figure 13:
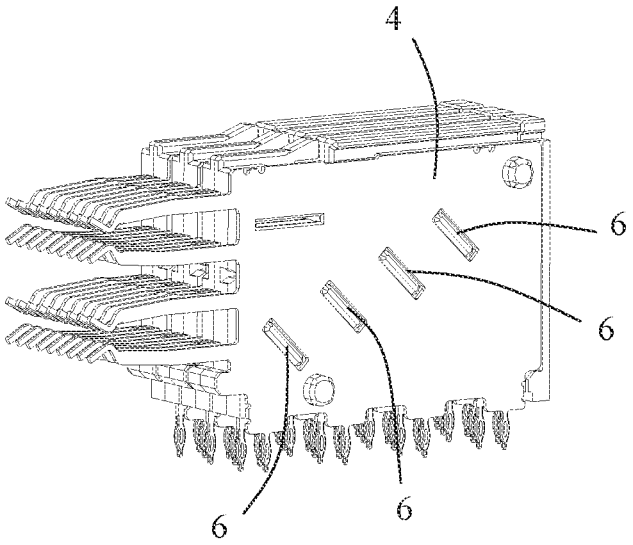
FIG. 13 is a partial perspective view of a connector in accordance with another embodiment of the present disclosure.
Figure 14:
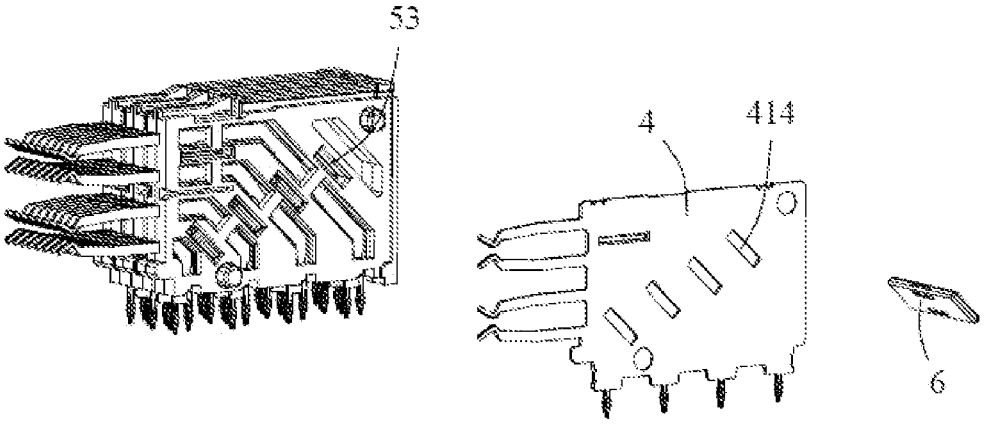
FIG. 14 is a further perspective exploded view of FIG. 13 with one of the shielding members being separated.
Figure 15:
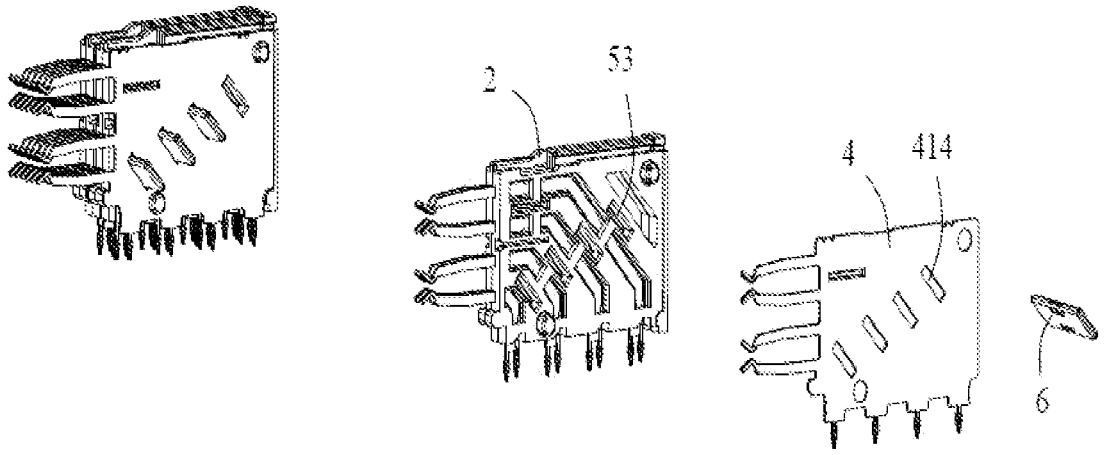
FIG. 15 is a further perspective exploded view of FIG. 14 with one terminal module being separated.

Referring to FIG. 11, the shielding member 6 is provided with a holding structure fixed to the ground plate 4. In the illustrated embodiment of the present disclosure, the holding structure includes a protrusion 61 which is locked in the through hole 414. In the illustrated embodiment of the present disclosure, the protrusion 61 of the shielding member 6 contacts the inner wall surface of the through hole 414 of the ground plate 4, so that the shielding member 6 and the ground plate 4 are electrically connected. Referring to FIGS. 13 to 15, in other embodiments, the shielding member 6 has no holding structure (such as the aforementioned protrusion 61), and the perforation hole 53 and the through hole 414 are both rectangular. The shielding member 6 is inserted in the perforation hole 53 and the through hole 414.

Referring to FIG. 12, a set of shielding members 6 on the right side are in contact with the rightmost ground plate 4 and the middle ground plate 4. A set of shielding members 6 on the left side are in contact with the leftmost ground plate 4 and the middle ground plate 4. With this arrangement, the shielding members 6 connect the ground plates 4 of all the terminal modules 2 in series, thereby increasing the shielding area and achieving a better shielding effect.

Referring to FIG. 12, as a modification of the specific embodiment of the present disclosure, the plurality of the shielding members 6 aligned along the installation direction C-C can also be arranged as a whole. Of course, in other embodiments, all the shielding members 6 can also be integrally formed to reduce the number of parts. Compared with the integral shielding member, in the illustrated embodiment of the present disclosure, except for the left-most terminal module 2, four shielding members 6 are inserted into each terminal module 2. These shielding members 6 with a shorter length along the installation direction C-C have lower requirements on the size of the perforation holes 53 of the terminal module 2 and reduce the processing difficulty of the perforation holes 53. In some cases, even if the shielding members 6 installed at the corresponding positions in the two terminal modules 2 are not completely aligned along the installation direction C-C, as long as the two ends of the shielding members 6 can contact the adjacent ground plates 4, it will not affect the shielding effect.

In an embodiment of the present disclosure, the connector 100 includes a shielding plate 7 located between the first slot 1221 and the second slot 1222. The shielding plate 7 is in contact with the ground plate 4 to further increase the shielding area and improve the shielding effect. The shielding plate 7 may be insert-molded in the housing 1; or there is a slot provided on the housing 1 to allow the insertion and fixation of the shielding plate 7. In the illustrated embodiment of the present disclosure, a plane where the shielding plate 7 is located is substantially perpendicular to a plane where the ground plate 4 is located. The shielding plate 7 is provided with a slot 71 for tightly holding all the ground plates 4. It can be understood that the shielding plate 7 is not in contact with the first signal terminals 31 or the second signal terminals 32 to avoid affecting signal transmission.

The above embodiments are only used to illustrate the present disclosure and not to limit the technical solutions described in the present disclosure. The understanding of this specification should be based on those skilled in the art. Descriptions of directions, such as "front", "back", "left", "right", "top" and "bottom", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A connector, comprising:

a housing comprising a receiving cavity, a mating surface, and a slot extending through the mating surface and communicating with the receiving cavity;

at least one terminal module at least partially accommodated in the receiving cavity, the at least one terminal module comprising a plurality of signal terminals and an insulating block, each signal terminal being provided with a contact portion extending into the slot;

at least one metal plate, the at least one metal plate and the at least one terminal module being arranged side by side along a thickness direction of the connector; and a shielding member extending along the thickness direction to contact the insulating block and to be electrically connected to the at least one metal plate.

2. The connector according to claim 1, wherein the shielding member is made of a conductive plastic.

3. The connector according to claim 1, wherein the at least one metal plate is a ground plate, the shielding member does not contact the ground plate and does not contact the signal terminals of the terminal module.

4. The connector according to claim 1, wherein the at least one metal plate is a ground plate, the shielding member contacts the ground plate and does not contact the signal terminals of the terminal module.

5. The connector according to claim 4, wherein the shielding member located in the terminal module is provided with a holding structure on a side of the shielding member along the thickness direction to be fixed to the ground plate.

6. The connector according to claim 1, wherein the signal terminals are insert-molded in the insulating block, and the at least one metal plate is installed on a side surface of the insulating block.

7. The connector according to claim 1, wherein a plurality of the terminal modules are provided, the insulating block of each terminal module comprises a first insulating block and a second insulating block, the signal terminals of each terminal module comprise a plurality of first signal terminals insert-molded in the first insulating block and a plurality of second signal terminals insert-molded in the second insulating block.

8. The connector according to claim 7, wherein the first insulating block is provided with a first perforation hole, and the second insulating block is provided with a second perforation hole;

wherein the at least one metal plate is provided with a through hole communicating with the first perforation hole and the second perforation hole; and wherein the shielding member is inserted in the first perforation hole, the second perforation hole and the through hole along the thickness direction.

9. The connector according to claim 1, wherein a plurality of the shielding members, a plurality of the terminal modules and a plurality of the metal plates are provided, each of the shielding members extends through a corresponding insulating block of a corresponding one of the terminal modules and a corresponding one of the metal plates along the thickness direction, and each adjacent two shielding members along the thickness direction are in contact with each other.

10. The connector according to claim 1, wherein a plurality of the metal plates are provided, two of the metal plates are respectively arranged on opposite sides of the insulating block, and the shielding member extends along the thickness direction to contact the insulating block and the two metal plates on the opposite sides of the insulating block.

11. The connector according to claim 10, wherein the insulating block comprises a first insulating block and a second insulating block, the signal terminals comprise a plurality of first signal terminals insert-molded in the first insulating block and a plurality of second signal terminals insert-molded in the second insulating block, the two metal plates are respectively arranged on outer sides of the first insulating block and the second insulating block, and the shielding member extends along the thickness direction to contact the first insulating block, the second insulating block, and the two metal plates on the outer sides of the first insulating block and the second insulating block.

12. The connector according to claim 1, further comprising a shielding plate, wherein the slot comprises a first slot and a second slot located below the first slot, two of the signal terminals extend into the first slot and the second slot, respectively, the shielding plate is located between the first slot and the second slot, and the shielding plate is in contact with the at least one metal plate.

13. A connector, comprising:

a housing comprising a receiving cavity, a mating surface, and a slot extending through the mating surface and communicating with the receiving cavity;

at least two terminal modules at least partially accommodated in the receiving cavity, each terminal module comprising a plurality of signal terminals and an insulating block, each signal terminal being provided with a contact portion extending into the slot;

at least two metal plates, each metal plate being arranged side by side with a corresponding insulating block along a thickness direction of the connector; and at least two shielding members, each shielding member extending through a corresponding insulating block of a corresponding one of the at least two terminal modules along the thickness direction and electrically connected to a corresponding metal plate;

wherein each adjacent two shielding members along the thickness direction are electrically connected with each other.

14. The connector according to claim 13, wherein each shielding member is made of a conductive plastic.

15. The connector according to claim 13, wherein each insulating block is provided with a perforation hole, each metal plate is provided with a through hole communicating with the perforation hole along the thickness direction, and each shielding member is inserted in a corresponding perforation hole and a corresponding through hole along the thickness direction.

16. The connector according to claim 15, wherein each shielding member comprises a protrusion on a side of the corresponding shielding member along the thickness direction, and the protrusion contacts an inner wall surface of the through hole of a corresponding one of the metal plates.

17. The connector according to claim 13, wherein the insulating block of each terminal module comprises a first insulating block and a second insulating block which are arranged side by side along the thickness direction.

18. A connector, comprising:

a housing comprising a receiving cavity, a mating surface, and a slot extending through the mating surface and communicating with the receiving cavity;

at least two terminal modules at least partially accommodated in the receiving cavity, each terminal module comprising an insulating block and a plurality of signal terminals secured in the insulating block, each signal terminal being provided with a contact portion extending into the slot;

at least two metal plates, each metal plate being a metal plate, each metal plate being arranged side by side with a corresponding insulating block along a thickness direction of the connector; and at least two shielding members, each shielding member extending through a corresponding insulating block along the thickness direction so as to contact a corresponding metal plate;

wherein the at least two shielding members along the thickness direction are connected in series.

19. The connector according to claim 18, wherein each shielding member is made of a conductive plastic.

20. The connector according to claim 18, wherein each insulating block is provided with a perforation hole, each metal plate is provided with a through hole communicating with the perforation hole along the thickness direction, and each shielding member is inserted in a corresponding perforation hole and a corresponding through hole along the thickness direction.

* * * * *